US007187130B2

(12) United States Patent
Sobieradzki et al.

(10) Patent No.: US 7,187,130 B2
(45) Date of Patent: Mar. 6, 2007

(54) ELECTRON BEAM TUBES INCLUDING A VACUUM ENVELOPE SEAL AND HAVING A METALLIZED BALANCE RING

(75) Inventors: Edward Stanley Sobieradzki, Colchester (GB); Stephen Bardell, Barnston (GB); Steven Aitken, Chelmsford (GB); Alan Wheelhouse, Braintree (GB)

(73) Assignee: E2V Technologies (UK) Limited, Chelmsford (GB)

( * ) Notice: Subject to any disclaimer, the term of this patent is extended or adjusted under 35 U.S.C. 154(b) by 0 days.

(21) Appl. No.: 10/792,905

(22) Filed: Mar. 5, 2004

(65) Prior Publication Data

US 2005/0200283 A1 Sep. 15, 2005

(30) Foreign Application Priority Data

Feb. 27, 2004 (GB) ..... 0404446.7

(51) Int. Cl.
*H01Q 23/14* (2006.01)

(52) U.S. Cl. ..... 315/5; 315/5.35

(58) Field of Classification Search ..... 315/5, 315/5.35, 5.37, 5.39, 5.51
See application file for complete search history.

(56) References Cited

U.S. PATENT DOCUMENTS 2,225,447 A 12/1940 Haeff et al.
2,903,614 A 9/1959 Preist et al.
3,392,308 A 7/1968 Cook
3,527,981 A 9/1970 Hopper, Jr. et al.
4,480,210 A * 10/1984 Preist et al. ..... 315/4

(Continued)

FOREIGN PATENT DOCUMENTS

EP 0 525 322 A1 2/1993

(Continued)

OTHER PUBLICATIONS

Patent Abstracts of Japan, vol. 017, No. 227, May 10, 1993, JP 04-357895A Manufacture of Ceramic Wiring Board.

(Continued)

*Primary Examiner*—Benny T. Lee
(74) *Attorney, Agent, or Firm*—Venable LLP; Robert Kinberg; Ryan M. Flandro

(57) ABSTRACT

A linear electron beam tube comprises an electron gun having a cathode and a grid, and an anode arranged in a first portion of a drift tube. The drift tube is within a vacuum envelope and has first and second portions separated by a gap at which point an electron beam, density modulated with an input RF signal is inductively coupled to an output cavity. The vacuum envelope is partially defined by a cylindrical ceramic wall and a pair of ferromagnetic pole pieces at its ends that form a DC magnetic circuit. The pole pieces extend radially beyond the vacuum envelope. At least those parts of the surface of the pole pieces that are in the RF path are coated with a layer of relatively low RF loss material such as copper. A balance ring separates the ceramic from the pole pieces. Further reduction in RF losses and relief from thermal stresses is obtained by forming the balance ring from the same ceramic as the cylindrical wall and metallizing at least that part of the outer surface of the balance ring that is on the RF path.

18 Claims, 4 Drawing Sheets

U.S. PATENT DOCUMENTS

| | | | | |
|---|---|---|---|---|
| 4,728,860 | A * | 3/1988 | Esterson et al. | 315/39 |
| 5,684,364 | A | 11/1997 | Heppinstall et al. | |
| 5,994,824 | A | 11/1999 | Thomas et al. | |

FOREIGN PATENT DOCUMENTS

| | | | |
|---|---|---|---|
| GB | 635479 | A | 4/1950 |
| GB | 766007 | A | 1/1957 |
| GB | 2 172 424 | A | 9/1986 |
| GB | 2 278 720 | A | 12/1994 |
| JP | 60-219801 | A | 11/1985 |
| JP | 4-349330 | A | 12/1992 |
| JP | 5-28928 | A | 2/1993 |

OTHER PUBLICATIONS

Patent Abstracts of Japan, vol. 017, No. 209, Apr. 23, 1993, JP 04-349330, "Magnetron".

* cited by examiner

ELECTRON BEAM TUBES INCLUDING A VACUUM ENVELOPE SEAL AND HAVING A METALLIZED BALANCE RING

CROSS-REFERENCE TO RELATED APPLICATION

This application claims the priority of United Kingdom Patent Application No. 0404446.7, filed Feb. 27, 2004, the disclosure of which is incorporated herein by reference.

BACKGROUND OF THE INVENTION

This invention relates to electron beam tubes. Particularly, but not exclusively to linear electron beam tubes, as used for example, in broadcast transmitters for amplifying RF signals for transmission.

A number of types of linear electron beam tubes are known for RF signal amplification. These types include klystrons and Inductive Output Tubes (IOT's) as well as travelling wave tubes. Traditionally klystrons have been used to amplify RF signals for broadcast. However, klystrons are relatively inefficient amplifiers and are very expensive to run. In recent years, IOTs have replaced klystrons as they are inherently more efficient and so reduce operating costs. More recently, an improved efficiency version of the IOT has been developed: the ESCIOT (Energy Saving Collector Inductive Output Tube) which uses a multi-stage depressed collector.

It is desirable for an electron beam tube in a transmitter to be able to broadcast both digital and analog television signals. A few years ago it was considered that analog signal transmitters would be phased out by 2006. However, it is now clear that this will not be the case. Analog signals require more power than their digital counterparts and there is, therefore, a need to improve the efficiency of devices designed with digital transmission in mind, and to minimize heat losses that occur within the device which will be more problematic at higher operating powers. As well as the requirement for Analog and Digital compatibility there is a general need to increase the efficiency of linear beam tubes to reduce operating costs.

Linear beam tubes are also used in other fields, for example in scientific applications such as synchrotrons, driving superconducting cavities and accelerators.

SUMMARY OF THE INVENTION

The invention, in its various aspects, addresses these needs.

In an aspect of the invention a vacuum tube is defined by the annular pole pieces and a tubular DC insulator wall. The wall is attached to the ferromagnetic pole pieces at its end by a flare, with a balance ring arranged at each end between the flare and the pole piece. The balance ring formed of a metallized insulator material with metallization applied over at least those surfaces that are on the RF path.

More specifically there is provided an electron beam tube, comprising a vacuum envelope partially defined by an end wall, a DC insulating RF transparent wall attached thereto, and a balance ring arranged between the end wall and the DC insulating wall, characterized in that the balance ring comprises metallized DC insulator material. The balancing ring is metallized over substantially its entire surface, or, alternatively, metallized on an RF current path when in use. The insulator wall is metallized, plated with nickel and overplated with copper.

Embodiments of this aspect of the invention have the advantage of reducing thermal stress, heating and electrical stress by reducing the length of the RF path between the pole piece and the flare and eliminating eddy currents while maintaining the same thermal expansion characteristic as the insulator wall.

BRIEF DESCRIPTION OF THE DRAWINGS

Embodiments of the invention will now be described, by way of example only, and with reference to the accompanying drawings in which.

DETAILED DESCRIPTION OF THE INVENTION

The present invention may be applied to any linear beam tube used for RF amplification, including IOTs, ESCIOTs, Klystrons, TWTs and other devices. The embodiment to be described is applied to a conventional IOT but this is not in any way limiting to the scope of the invention. A linear beam tube embodying the invention is particularly suited for use with broadcast transmitters but may be used in any other environment in which high power RF amplification is required.

An inductive output tube has an electron gun which produces a beam which is focused by a magnetic field. The beam is density modulated by the RF signal to be amplified and RF power extracted from the density modulated beam by a resonant output cavity. The Klystron differs from the IOT in that it uses velocity modulation of the electron beam to amplify the RF input.

Density modulation in an IOT is achieved by a grid arranged in front of the cathode and isolated therefrom by a ceramic insulator such as aluminium oxide. The RF signal enters the tube through the ceramic insulator and is applied to the grid. An anode is arranged at a distance from the cathode and grid and is separated by a further ceramic insulator. The anode is grounded. The further ceramic insulator holds off the full beam voltage, typically of about 30 kv.

Figure 1:
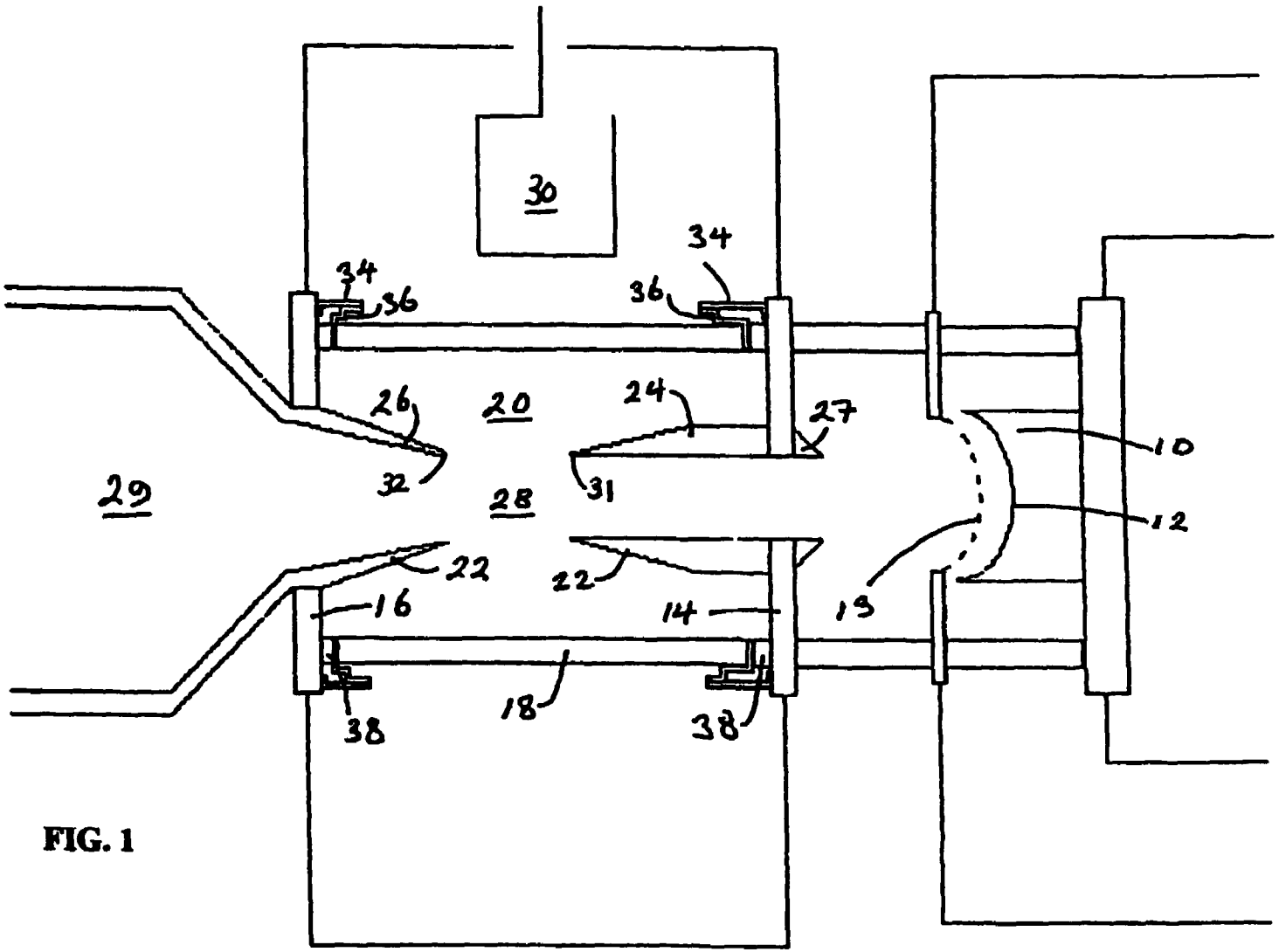
FIG. 1 is a section through a portion of an IOT embodying aspects of the invention.
Figure 2:
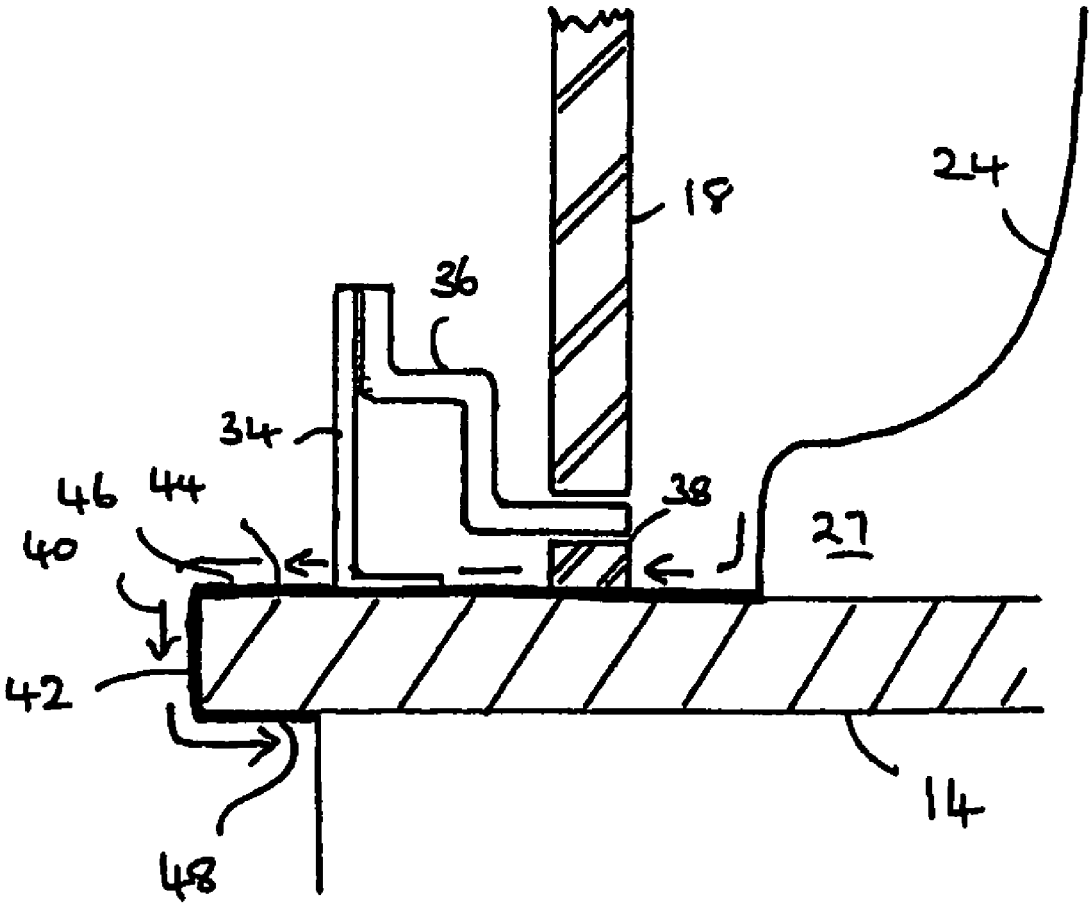
FIG. 2 is an enlarged view of a part of a pole piece of the IOT of FIG. 1 embodying a first aspect of the invention.

FIG. 1 shows a portion of an electron beam tube embodying the invention. The device shown is an IOT having an electron gun assembly shown generally at 10. The gun includes a thermionic cathode 12 and a grid 13. The electron beam generated by the cathode is focused by magnetic coils (not shown) and shaped by pair of ferromagnetic pole pieces, 14, 16, which, with a ceramic insulator 18 therebetween, define a vacuum envelope 20. The ceramic insulator, also known as an RF window or an output ceramic, is transparent to RF but is a DC insulator. The ferromagnetic pole piece 14 is connected to the insulator 18 by a pair of flares 34, 36, which are discussed in more detail with regard to FIG. 2. It will be appreciated from FIG. 1 that the pole pieces 14, 16 extend radially beyond the vacuum envelope 20. Within the envelope 20 is a two-part drift tube 22, the two parts 24, 26 being separated by a gap 28. Electrons enter the RF interaction region via a first part 24 of the drift tube 22, which is typically copper and has an annular flange 25, which forms a part of the anode 27. Between the first portion 24 of the drift tube 22 and a second part 26 of the drift tube 22 is a gap 28 at which point the RF modulated beam is inductively coupled to an output cavity 30 to provide an output signal. Only a portion of the output cavity 30 is shown in FIG. 2. The drift tubes are so called as both portions 24 and 26 are at DC ground potential and there is no acceleration of the electric beam within them. The ceramic insulator 18 is a cylindrical tube, preferably made of Alumina which is transparent to RF. A shim or balance ring 38 is arranged between the insulator 18 and ferromagnetic pole piece 14. The ends of the insulator are attached to the magnetic pole pieces 14, 16 by an arrangement shown in more detail in FIG. 2. The construction described is well known and embodied, for example, in the IOTD2100 available from e2v Technologies Ltd of Chelmsford UK.

The second portion 26 of the drift tube is flared and has a serrated inside surface. The electron beam passes through the drift tube, through an aperture in the second magnetic pole piece 16 and into a collector 29, only a portion of which is shown. The purpose of the collector is to slow down the electron beam after RF amplification. The collector may be a conventional collector or a multistage depressed collector. The design of the collector is outside the scope of the present invention.

The ends 31, 32 of the two drift tube portions 24, 26 may be made of molybdenum.

The ferromagnetic pole pieces 14, 16 are essential for correct shaping of the electron beam. Each comprises an annulus of ferromagnetic material having a central aperture through which the beam passes. The pole pieces are typically Nickel or Iron. The magnetic field is provided by an external device such as a pair of magnetic solenoid coils (not shown), and the pole pieces acting together to generate a linear magnetic flux in the vacuum envelope defined by the ceramic insulating tube 18 and the pole pieces 14, 16. The size of the center holes in the annular pole pieces determines the shape of the magnetic field, and therefore, the electron beam. The pole pieces complete a DC magnetic circuit.

It will be appreciated from FIG. 1 that the ferromagnetic pole pieces have surfaces that, when the device is in use, are RF visible, and that the pole pieces partially form a wall of an RF cavity, namely the vacuum envelope. A ferromagnetic material such as iron or nickel is an undesirable material for such a cavity as it is RF lossy; it is not a good conductor at RF frequencies as it has a poor skin depth. This leads to a loss in efficiency and generation of unwanted heat. In order to improve RF performance, an embodiment of the invention coats the ferromagnetic pole pieces with a good RF conductor such as copper. It is preferred to coat the entire pole piece as this is the most convenient way of applying a coating. However, it is only necessary to coat the RF visible surfaces of the pole pieces. Although it is preferred that at least the RF visible surfaces of both pole pieces are coated, benefit is obtained by coating at least the RF visible surfaces of only one of the pole pieces.

FIG. 2 shows a portion of the RF resonant cavity of FIG. 1 in more detail. The numbering convention used is the same as in FIG. 1. The ferromagnetic pole piece 14 is connected to the Alumina insulator sleeve 18 by a pair of flares 34, 36. The outer flare 34 is brazed to the pole piece 14 and the inner flare 36 is brazed to the end of the insulator sleeve 18. The free ends of the two flares 34, 36 are welded together to join the sleeve 18 to the pole piece 14, 16. The flares 34, 36 are typically copper coated nickel. A shim or balance ring 38 is arranged between the cylindrical RF window and the ferromagnetic pole piece 14, 16. The shim 38 is brazed to the underside of the inner flare 36. The RF window, flare and balance ring assembly acts as a means of sealing the vacuum envelope 20 and relieving thermal stresses. A similar arrangement is used to seal the second ferromagnetic pole piece 16 (not shown in FIG. 2) to the ceramic RF window 18.

FIG. 2 also shows the anode 27 and the first portion 24 of the drift tube. This element is typically made of copper and is a good RF conductor. Dashed line 40 shows the RF path that includes the circumferential face 42 of the ferromagnetic pole piece and an outer annular portion 44 of the inner face 46 of the pole piece. It is these portions that are coated with a layer of a good RF conductor such as copper. The copper coating is shown at 48 and also covers a small outer annulus of the outer face 50 which may also lie on the RF path depending on the geometry of the tube. It will be appreciated that the coating is required not only on the surface of the pole pieces that is within the vacuum envelope but also on surfaces outside the vacuum envelope that are on the RF path.

The coating may be applied to the pole pieces by any convenient method, including but not limited to: plating, cladding, coating or sandwiching. Although copper is presently preferred, other good RF conductors such as silver may be used. The material used should have a better conductivity at RF frequencies than the ferromagnetic material. Both copper and silver have a greater skin depth at RF and so are less lossy. The material used should have an RF loss characteristic that is less than the RF loss characteristic of the ferromagnetic material.

Although the embodiment described is applicable to any linear beam tube, it has particular advantage with IOTs and ESCIOTs in which the currents circulating in the resonant cavity can be tens or even hundreds of amps. Surface losses from the RF exposed parts of the ferromagnetic pole pieces can lead to surface losses and undesired heating. This can be a particular problem when operating IOTs at the high powers required for Analog broadcast transmission. ESCIOTs tend to use iron as the pole piece as iron has a higher magnetic saturation, (permeability) but a higher surface resistivity to UHF currents. Iron performs better at higher temperatures and a thicker first portion of the drift tube can remove some of the heat. In addition, the multistage depressed collector used in ESCIOTs can give rise to an additional source of heating caused by returning electrons.

Figure 3A:
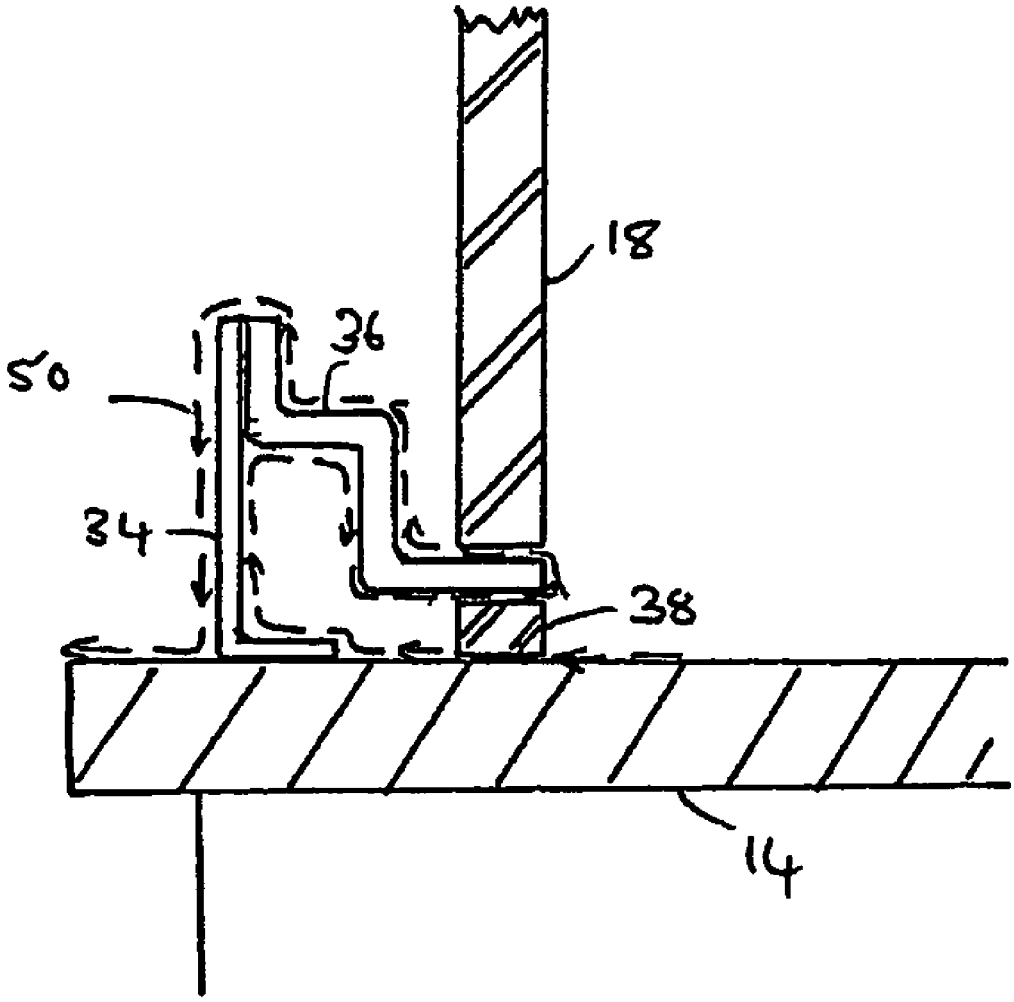
FIG. 3a (Prior Art)
FIG. 3*a* is an enlarged view showing the r.f. path at the connection between the pole piece and a ceramic insulator in a known IOT.
Figure 3B:
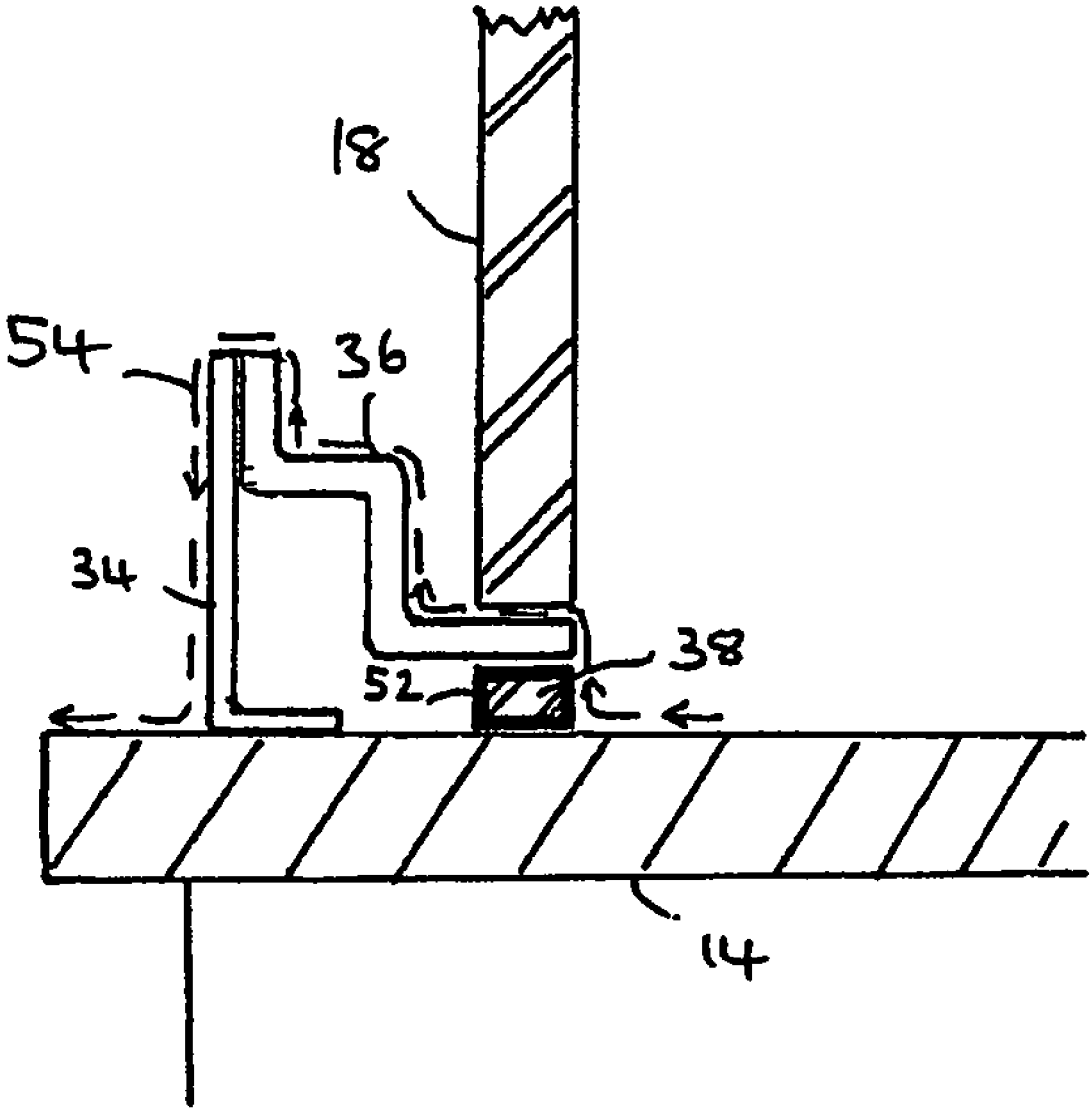
FIG. 3*b* is a similar view to FIG. 3*a* showing an embodiment of a second aspect of the invention.

Referring back to FIG. 2, the balance ring 38 is typically made of the same ceramic as the insulator sleeve 18. Although a copper balance ring is RF conductive and can reduce heat losses, it is undesirable as it has different expansion properties from the sleeve insulator 18. It is desirable therefore to use a ceramic material as the balance ring 38, preferably using the same material as the insulator sleeve 18. FIG. 3*a* shows how this gives rise to high losses, caused partially by eddy currents and partially by a lengthening of the RF path. In FIG. 3*a*, the RF path is shown as a dashed line 50. It extends over the outside of the outer and inner flares 34, 36 and then loops around between the inner flare 36 and the balance ring 38, between the inner flare 36 and the insulator sleeve 18, along the inner surface of the outer flare 34 and along the surface of the substrate pole piece 14. The numbering convention used is the same as in FIGS. 1 and 2. Eddy currents will be generated in the space between the two flares 34, 36 Eddy currents are eliminated, and the RF path shortened in an embodiment of the second aspect of the invention shown in FIG. 3*b*. The numbering convention used is the same as in FIGS. 1 and 2. The balance ring 38 is ceramic, again preferably the same ceramic as the insulator sleeve 18 but it has a copper coating 52. The effect that this has on the electrical path can be seen from the dashed line 54 that shows the RF path as extending only over the outer surfaces of the inner and outer flares 36, 34. It will be appreciated that as the purpose of metallization of the ceramic balance ring 38 (in addition to providing a means of brazing the balance ring 38 to the flare 36), is to short the RE path, so it is not essential to metallize all surfaces of the ring 38. For example, the outer face of the ring 38 opposite the outer flare 34 need not be metallized and the lower surface, which contacts the pole piece 14 need only be metallized to the extent that an electrical connection is made between the pole piece 14 and the balance ring 38. In practice it is preferred, and convenient, to metallize all of the surfaces of the balance ring 38.

In the embodiment shown, the balances rings 38 are arranged on the ferromagnetic pole pieces 14, 16 and connected thereto by the flares 34, 36. Other designs are known in which balance rings 38 attach to a separate wall, typically copper, with the pole pieces being separate from the vacuum envelope. Metallization of the balance ring 38 is also advantageous for this configuration.

The effect of metallizing the ceramic ring 38 is to reduce heat losses and to reduce thermal stresses that can lead to cracking of the insulator sleeve 18 or the balance ring 38 when the flares 34, 36 are brazed into place. The same expansion is achieved in the balance ring 38 as the insulator sleeve 18 because as the same material is used.

The balance ring 38 may be metallized using known techniques. For examples, a powdered molybdenum manganese alloy and binder is fused to the surface of the Alumina balance ring 38. The binder is lost in processing, leaving a surface which is then nickel plated and over-plated with copper to reduce loss further. Other materials could be used, for example silver is suitable as it has good RF conductivity.

Thus, the embodiment described fully metallizes the ceramic balance ring 38 to enable RF losses to be reduced and to enable stresses associated with thermal processing and the operation to be relieved.

The embodiments of the two aspects of the invention described have been described with reference to the pole piece 14 to which the first drift tube portion 24 including the anode 27 is attached. A similar construction of flares 34, 36 and a balance ring 38 is used to attach the second end of the insulating sleeve 18 to the second pole piece 16. It is preferred that the surfaces of the second pole piece 16 are also coated with a good RF conductor and that the second balance ring 38 is also metallized in accordance with the embodiments of the first and second aspects of the invention described above.

It will be appreciated that the embodiments described both have the advantage of reducing RE losses and consequently improving the efficiency of the tube. This contributes to tubes being able to operate at higher power, which is desirable for analog signal broadcasting, and to reduce operating energy requirements. Although particularly suited to ESCIOTs and conventional IOTs, the embodiments described as also applicable to all other high power linear beam tubes including Klystrons.

Various modifications may be made to the embodiments described without departing from the scope of the invention, which is defined by the following claims.

The invention has been described in detail with respect to exemplary embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An electron beam tube comprising:

a vacuum envelope partially defined by an end wall;

a DC insulating RF transparent wall attached to the end wall; and a balance ring arranged between the end wall and the DC insulating RF transparent wall, wherein the balance ring comprises metallized DC insulator material and wherein the balance ring is metallized over substantially the entire outer surface thereof.

2. The electron beam tube according to claim 1, wherein the end wall is attached to an end of the DC insulating RF transparent wall by a flare, and the metallized balance ring is also attached to the flare.

3. The electron beam tube according to claim 1, further comprising a further metallized balance ring arranged between an opposite end of the DC insulating RF transparent wall and a further end wall, the further metallized balance ring being attached to the opposite end of the DC insulating RF transparent wall by a further flare.

4. The electron beam tube according to claim 1, wherein the balance ring DC insulator material is a ceramic.

5. The electron beam tube according to claim 4, wherein the ceramic is aluminum oxide.

6. An electron beam tube comprising:

a vacuum envelope partially defined by an end wall;

a DC insulating RF transparent wall attached to the end wall; and a balance ring arranged between the end wall and the DC insulating RF transparent wall, wherein the balance ring comprises metallized DC insulator material and wherein the metallized DC insulator material comprises nickel-plated insulator material having a copper layer over-coated thereon.

7. The electron beam tube according to claim 6, wherein the end wall is attached to an end of the DC insulating RF transparent wall by a flare, and the metallized balance ring is also attached to the flare.

8. The electron beam tube according to claim 6, further comprising a further metallized balance ring arranged between an opposite end of the DC insulating RF transparent wall and a further wall, the further metallized balance ring being attached to the opposite end of the DC insulating RF transparent wall by a further flare.

9. The electron beam tube according to claim 6, wherein the balance ring DC insulator material is a ceramic.

10. The electron beam tube according to claim 9, wherein the ceramic is aluminum oxide.

11. An electron beam tube comprising: a ferromagnetic pole piece forming part of a DC magnetic circuit, a part of the ferromagnetic pole piece forming a wall of a vacuum envelope, the pole piece extending beyond the vacuum envelope and having over at least a portion of the outer surface thereof which, in use, is part of the RF path of the tube, a layer with a radio frequency (RF) loss characteristic less than an RF loss characteristic of the ferromagnetic material, and wherein the vacuum envelope comprises a wall of DC insulating RF transparent material attached to the ferromagnetic pole piece by at least one flare, and a balance ring arranged between the ferromagnetic pole piece and an end of the DC insulating RF transparent wall, the balance ring comprising metallized DC insulator material.

12. The electron beam tube according to claim 11, wherein the DC insulator material of the balance ring is the same material as the DC insulating RF transparent wall.

13. The electron beam tube according to claim 11, wherein the metallized DC insulator material comprises nickel-plated DC insulator material having a copper layer overplated thereon.

14. The electron beam tube according to claim 11, wherein the balance ring DC insulator material is a ceramic.

15. The electron beam tube according to claim 14, wherein the ceramic is aluminum oxide.

16. The electron beam tube according to claim 11, comprising a further metallized balance ring arranged between an opposite end of the DC insulating RF transparent wall and a further ferromagnetic pole piece, the further metallized balance ring being attached to the opposite end of the DC insulating RF transparent wall by a further flare.

17. The electron beam tube according to claim 11, wherein the balance ring is metallized over substantially the entire outer surface thereof.

18. The electron beam tube according to claim 11, wherein the metallized balance ring is attached to the at least one flare.

* * * * *